United States Patent [19]

Crumbley, II

[11] Patent Number: 5,038,643

[45] Date of Patent: Aug. 13, 1991

[54] SOCKET WRENCH EJECTOR

[76] Inventor: Jerry J. Crumbley, II, 1108 Village West Dr., Austin, Tex. 78733

[21] Appl. No.: 459,187

[22] Filed: Dec. 29, 1989

[51] Int. Cl.[5] ..... B25B 13/02

[52] U.S. Cl. ..... 81/124.1; 81/177.85

[58] Field of Search ..... 81/124.1, 177.85

[56] References Cited

U.S. PATENT DOCUMENTS

| | | | |
|---|---|---|---|
| 1,629,217 | 5/1927 | Largent et al. | 81/124.1 |
| 2,264,573 | 12/1941 | Johnson et al. | 81/124.1 |
| 2,811,883 | 11/1957 | Cleaves | 81/124.1 |
| 4,520,697 | 6/1985 | Moetteli | 81/124.1 X |

*Primary Examiner*—James G. Smith

*Attorney, Agent, or Firm*—Richards, Medlock & Andrews

[57] ABSTRACT

A nut ejector assembly (10, 100) is disclosed which can be used to eject a nut stuck in a socket (14). The nut ejector assembly includes a resilient control pin (40) which preferably has a pair of oppositely curved legs (42, 44) which are retracted into a passage (34) in the socket drive when the retracted position. When a nut is to be released, the control pin is moved to the release position where the legs extend from the socket drive to curve outwardly into the through passage (16) in the socket to catch the nut and hold the nut or eject the nut.

4 Claims, 1 Drawing Sheet

SOCKET WRENCH EJECTOR

TECHNICAL FIELD

This invention relates to hand tools, and in particular to a device to eject a nut stuck in a socket.

BACKGROUND OF THE INVENTION

One annoying and time consuming aspect of the use of a socket wrench is the sticking of a nut within the socket once the nut is unthreaded from its associated bolt or stud. The nut may stick because it is covered with grease or dirt, which causes the nut to be held within the socket. In other situations, the nut may be jammed within the socket because of the forces exerted in unthreading the nut. In the past, it has been typical to pound the socket against the floor or another surface to knock the nut out of the socket or, if using an air or electric powered impact or rachet wrench, spinning the stuck nut from the socket to send the nut flying across the floor or through the air, or alternatively, to use a screwdriver or some other pointed object to wedge out the nut, all of which are time consuming and annoying. Also, whenever a sharp tool is used to pry an object from where it is stuck, or a nut flies from a powered tool, the potential arises for personnel injury. Certainly, if the nut could be ejected directly into a can or box, productivity would be increased.

Attempts have been made in the past to facilitate the release of a nut stuck in a socket. U.S. Pat. No. 1,629,217 to Largent discloses a socket wrench system which includes means to eject the nut from the socket. The shaft or handle bar 5, of the wrench has a longitudinal bore 11 for a slidable ejector pin 12 which is rigidly attached to the sleeve 16, which is slidable along the shaft. When the sleeve is moved forward it drives the ejector pin which engages a second pin 19 that rigidly locks the socket in place while the nut is being ejected A circular disc 13 is attached to the forward end of the pin 12 to engage the nut and eject it from the socket.

U S. Pat. No. 2,264,573 to Johnson discloses a nut ejector system which includes resilient ejector members 35 which expand radially when advanced from the board 25. The ejector members expand until they contact the internal wall of the socket, and their continued advancement pushes the nut clear of the socket. The ejector members are shaped like claws 36 so as to provide the additional function of grasping articles when the socket is removed.

A satisfactory ejector has yet to be developed for use in the mass market. Thus, a need still exists for such a device.

SUMMARY OF THE INVENTION

In accordance with one aspect of the present invention, a nut ejector assembly is provided for use with conventional sockets. The socket has a through aperture defining at a first end a nut engaging surface and at the opposite end a drive surface. The nut ejector assembly includes a wrench member having a drive end for engaging the drive surface on the socket to rotate the socket, and an ejector portion adjacent the drive end. The ejector portion has a notch formed therein and a passage is formed through the drive end of the wrench member which opens into the notch. A curved resilient control pin is received in the notch and extends into the passage. The control pin is slidable in the passage from a retracted position where the control pin does not interfere with the nut received in the socket to a release position where the nut is expelled from the socket by the control pin.

In accordance with another aspect of the present invention, the control pin is split and has two parallel resilient arms curved in opposite directions. When the control pin is moved into the release position, the resilient arms expand in opposite directions in the through aperture of the socket to catch the nut and eject it from the socket.

In accordance with yet another aspect of the present invention, a socket locking mechanism is provided which includes an opening formed in the drive end extending from the passage and opening against the drive surface of the socket. A locking ball is captured within the opening. A locking rod is urged against the locking ball as the control pin is moved to the release position to urge the locking ball against the drive surface of the socket to lock the socket on the wrench member.

In accordance with yet another aspect of the present invention, the beveled and curved arm of the control pin is designed so the tool works with all sizes of sockets in a given drive size, with large sockets or small. In the present invention the bevels and curves of the control pin acts in a way to catch the stuck nut by its threads, giving a secure grip to the nut to release the nut from the socket.

BRIEF DESCRIPTION OF THE DRAWINGS

Further objects and advantages of the invention will become more apparent from the description and claims, and from the accompanying drawings, wherein:

DETAILED DESCRIPTION

Figure 2:
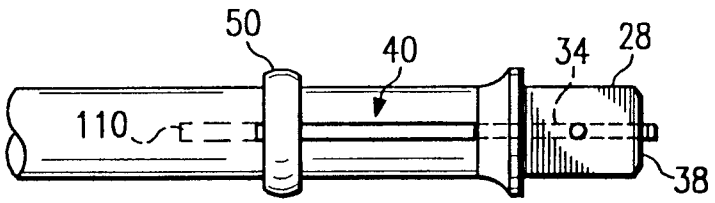
FIG. 2 is a horizontal cross sectional view of the wrench member.

With reference to the accompanying figures, wherein like reference numerals designated like or corresponding parts throughout the several views, and particularly to FIGS. 1–4, a nut ejector assembly 10 is shown to be part of an extension 12 for rotating a socket 14. While the assembly 10 is shown on an extension 12, it will be readily apparent that assembly 10 can be incorporated in a ratchet wrench, a breaker bar, a power wrench, or any other mechanism intended to rotate sockets.

Socket 14 is a conventional socket of any size, with a through passage 16 formed through the socket along its center line 18. The first end 20 of the passage defines a socket engaging surface 22, which is commonly either a 6 or 12 point configuration. The opposite end 24 defines a drive surface 26, which is most typically square in cross section.

The extension 12 has a drive end 28, again usually of square cross-section, which fits within end 24 of the socket 14 so that rotation of the extension 12 rotates the socket 14.

The extension 12 has an ejector portion 30 which is adjacent the drive end 28. A notch 32 is formed into the ejector portion 30. A passage 34 is formed through the drive end 28, centered on the center line 36 of the extension 12. Center lines 36 and 18 correspond when the socket is mounted on the extension. The passage opens through the end surface 38 of the drive end 28 and also into the notch 32.

Figure 1:
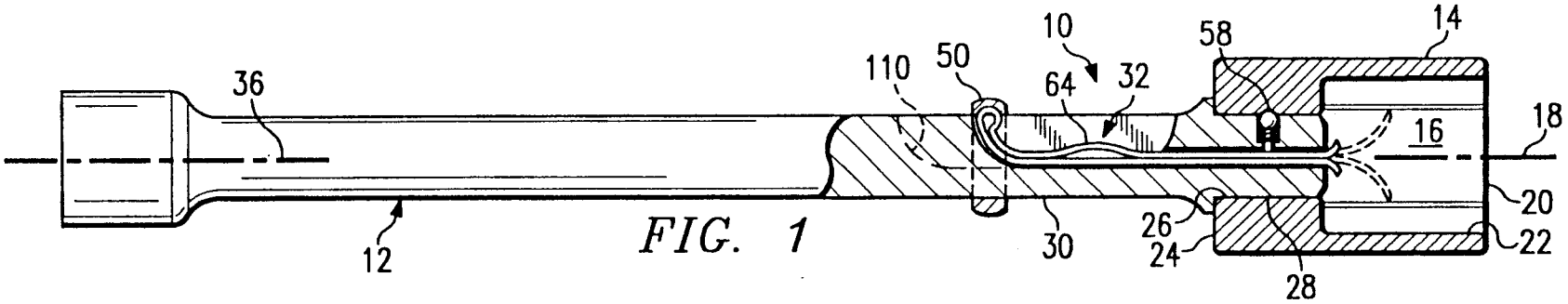
FIG. 1 is a side cross sectional view of a wrench member and socket illustrating a first embodiment of the present invention.
Figure 3:
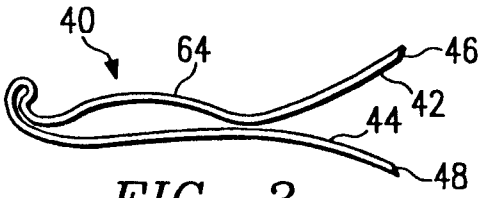
FIG. 3 is a side view of the control pin used in the invention.
Figure 4:
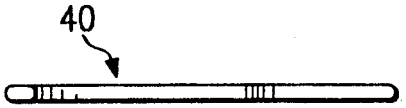
FIG. 4 is a top view of the control pin.

A resilient control pin 40 is received in the notch 32 and extends into passage 34. The control pin 40 is preferably formed of flat spring steel. As best seen in FIGS. 3 and 4, the control pin 40 has oppositely curved legs 42 and 44 which curve away from each other when the pin is unconstrained to bevelled ends 46 and 48. As can been in FIGS. 1 and 2, the control pin 40 is slidable within the notch 32 and passage 34 between a retracted position and a release position. In the retracted position, the control pin is moved away from the socket, to the left as shown in FIGS. 1 and 2, to the furthest extent possible. This retracts the legs 42 and 44 into the passage 34 so that no portion of the legs, or a very small portion thereof, extend through the end surface 38 into the through passage 16 to interfere with the normal operation of the socket in overfitting a nut for removal.

The control pin can be moved from the retracted position to the release position, where a significant portion of the legs 42 and 44 extend from the end surface 38 into the through passage 16 of the socket 14. The portion of the legs so extending is sufficient to allow the natural resiliency of the curved legs to allow the legs to curve away from the center line 18 in opposite directions within the through passage 16. The bevelled ends 46 and 48 thus are quite likely to engage either the threads on the nut within the socket or the inner side of the nut itself. Further movement of the control pin to the release position causes the nut to be ejected from the socket as the legs drive the nut outward.

Figure 1A:
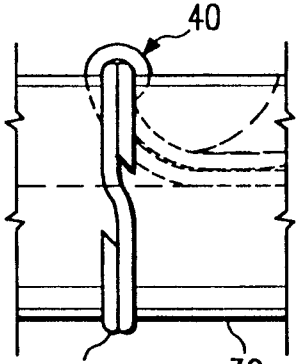
FIG. 1A is an illustration of an alternate ring for the present invention.

To facilitate movement of the control pin between the retracted and release positions, a ring 50 is mounted on the end cf the control pin within the notch 32 and extends concentric with the extension 12 to allow the thumb or fingers to more readily move the control pin. Ring 50 can be a solid ring as shown in FIG. 1, or a split, key chain type ring 50' as seen in FIG. 1A or any other suitable design.

Figure 6:
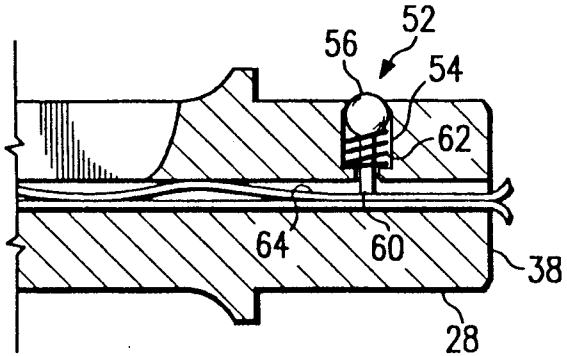
FIG. 6 is a vertical cross sectional view of the locking modification of the present invention.

If the socket 14 is not securely fit on the extension 12, and the nut is very tightly jammed in the socket, movement of the control pin 40 to the release position could actually push both the nut and socket off the extension. To prevent this possibility, a locking pin mechanism 52 can be provided in the extension 12, which is best illustrated in FIG. 6. The locking mechanism includes an opening 54 in the drive end 28 which extends generally perpendicular the center line 36. One end of the opening 54 opens into the passage 34, while the opposite end of the opening opens against the drive surface of the socket 14 when the socket is received on the extension. A locking ball 56 is captured within the opening 54 so that a portion of the ball 56 can extend outwardly from the opening 54 and into a suitable groove or notch 58 formed on the socket to lock the socket to the extension. A locking rod 60 is also positioned in the opening 54 and extends into the passage 34. A helical spring 62 is also mounted in the opening 54 which acts against an edge of he opening 54 and the ball to urge the ball outwardly into engagement with the socket.

As can be seen in FIGS. 3 and 6, the control pin has shoulders 64 located along the legs 42 and 44. In the retracted position, shoulders 64 are positioned to permit the locking rod 60 to extend within the passage sufficiently so that the socket can be removed from the extension by simply pulling the socket off the extension and thereby forcing the locking ball 56 into the opening 54 against the action of the spring 62. However, as the control pin is moved to the release position, the shoulders 64 engage the locking rod 60 to urge the locking ball outward from the extension and into the groove 58 on the socket. The socket is then locked on to the extension and further movement of the control pin must force the nut from the socket, rather than pushing the socket off of the extension.

Figure 5:
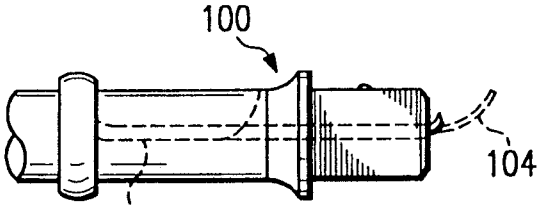
FIG. 5 is a vertical cross sectional view of the present invention.

With reference now to FIG. 5, a first modification of the present invention is illustrated as nut ejector assembly 100. The nut ejector assembly is in all respects identical to nut ejector assembly 10, except that the control pin 102 has but a single curved leg 104. The nut ejector assembly 100 can be used in less severe conditions than nut ejector assembly 10, and may be slightly less expensive by reducing the material requirements.

It is quite common to use short sockets, such as socket 14, and deep sockets with a quite long through passage, with the same wrench. In the present invention, the nut ejector assembly 10 can be suitable for both standard and deep sockets by providing sufficient movement of the control pin from the retracted to release position. Alternatively, a second notch 110, shown in phantom line in FIG. 1 and FIG. 2, could be formed in the extension 12 to receive a second resilient control pin which has longer legs than legs 42 and 44. Further, while extension 12 is seen to have a conventional parallel sided drive end, the extension could as easily have an angled drive end instead.

The advantages of the present invention can be realized on any size drive, including, for example $\frac{3}{8}$ inch, $\frac{1}{4}$ inch, $\frac{1}{2}$ inch, $\frac{3}{4}$ inch or 1 inch.

It can well be appreciated that the advantages of this present invention can save many man hours at all repair shops by avoiding the need to pound stuck nuts from sockets which would, in turn, allow him or her to be faster and more efficient at work. It would also save wear and tear on air compressors and tools when using air tools, and the electricity needed to run the compressor because it would no longer be necessary to rotate the air wrench to help get a stuck nut out of the socket. The advantages of the present invention should make all other types of socket extensions obsolete because of the fact that it can perform the same functions, perhaps even better, than a regular extension with the added advantage of the ejector. The tool can be used on virtually any size nut providing the same size drive extension as used with the appropriate socket.

The present invention can be used in conjunction with a magnetized socket which would be especially beneficial for airplane mechanics or other specialty mechanics, allowing them to positively retrieve or place a nut in greasy, oily, tight spots with assurance that the nut will not be lost. In certain circumstances, the loss of a nut in a particularly sensitive area can require the mechanic to completely tear down an engine or unit to retrieve the single nut. Such problems would be virtually eliminated with the present invention.

Although a single embodiment of the invention has been illustrated in the accompanying drawings and described in the foregoing Detailed Description, it will be understood that the invention is not limited to the embodiment disclosed, but is capable of numerous rearrangements, modifications and substitutions of parts and elements without departing from the spirit and scope of the invention.

I claim:

1. A nut ejector assembly for use with a socket, the socket having a through aperture aligned along a first direction defining at a first end a nut engaging surface and at the opposite end a drive surface, the nut ejector assembly comprising:

a wrench member having a drive end for engaging the drive surface on the socket to rotate the socket and an ejector portion adjacent the drive end, the ejector portion having a notch formed therein, a passage being formed through the drive end of the wrench member and opening into the notch;

a curved resilient control pin received in the notch and extending into the passage, said curved resilient control pin having at least one curved leg ending in an outwardly beveled end;

the control pin slidable in the passage from a retracted position where the control pin does not interfere with the nut received in the socket to a release position, the curved leg resiliently curving from the first direction into contact with a nut as the control pin is moved to the release position, the outwardly beveled end engaging the threads of the nut whereby the nut is expelled from the socket by the control pin.

2. The nut ejector assembly of claim 1 wherein the control pin has a pair of oppositely curved resilient legs.

3. The nut ejector assembly of claim 1 wherein the curved resilient control pin curves into the through aperture of the socket as the pin is moved to the release position to engage the nut.

4. The nut ejector assembly of claim 1 further having a socket locking mechanism, said socket locking mechanism including:

said drive end having an opening extending from the passage and opening against the drive surface of the socket;

a locking ball positioned in the opening;

a spring to urge the locking ball into engagement with the drive surface of the socket to hold the socket to the wrench member with the control pin in the release position;

a locking rod positioned in the opening and extending into the passage, said curved resilient control pin having a shoulder which contacts the locking rod as the control pin is moved to the release position to urge the control rod against the locking ball to engage the locking ball with the drive surface of the socket to lock the socket to the wrench member.

* * * * *